US006050009A

United States Patent [19]

Adamson et al.

[11] Patent Number: 6,050,009

[45] Date of Patent: Apr. 18, 2000

[54] STEERABLE UNDERWATER PLOW

[75] Inventors: James E. Adamson, West Palm Beach, Fla.; Jonathan B. Machin, Aberdeenshire, United Kingdom

[73] Assignee: Coflexip, S.A., Paris, France

[21] Appl. No.: 08/964,361

[22] Filed: Nov. 4, 1997

[51] Int. Cl.[7] ..... E02F 5/18

[52] U.S. Cl. ..... 37/367; 37/370; 405/161

[58] Field of Search ..... 405/158, 161, 405/162, 164, 174, 184; 61/72.4, 72.7, 72.6, 72.5; 172/699, 464, 483, 487, 711; 37/325, 366, 367, 380, 370

[56] References Cited

U.S. PATENT DOCUMENTS

| | | |
|---|---|---|
| 2,756,654 | 7/1956 | Porterfield, Jr. et al. . |
| 3,140,745 | 7/1964 | Hinkle et al. . |
| 3,431,741 | 3/1969 | Kinnan . |
| 3,454,285 | 7/1969 | Van Peursem . |
| 3,788,085 | 1/1974 | Holberg . |
| 3,824,798 | 7/1974 | Shiroyama et al. . |
| 4,011,727 | 3/1977 | Suzuki et al. . |
| 4,069,679 | 1/1978 | Manley, Jr. . |
| 4,106,335 | 8/1978 | Shatto . |
| 4,141,667 | 2/1979 | Brown . |
| 4,208,813 | 6/1980 | Latimer . |
| 4,249,324 | 2/1981 | Latimer . |
| 4,312,144 | 1/1982 | Ezoe . |
| 4,314,414 | 2/1982 | Reynolds et al. . |
| 4,329,793 | 5/1982 | Reece . |
| 4,384,415 | 5/1983 | Brown et al. . |
| 4,395,158 | 7/1983 | Brooks . |
| 4,410,297 | 10/1983 | Lynch . |
| 4,428,132 | 1/1984 | Reece . |
| 4,488,836 | 12/1984 | Cour . |
| 4,538,937 | 9/1985 | Lynch . |
| 4,585,372 | 4/1986 | Grinsted et al. . |
| 4,655,639 | 4/1987 | Reece . |
| 4,664,553 | 5/1987 | Grinsted et al. . |
| 4,759,138 | 7/1988 | Grinsted . |
| 4,802,793 | 2/1989 | Grinsted et al. . |
| 4,892,443 | 1/1990 | Kunze et al. . |
| 4,986,697 | 1/1991 | Lynch . |
| 5,639,185 | 6/1997 | Saxon . |

FOREIGN PATENT DOCUMENTS

| | | |
|---|---|---|
| 0 074 802 | 3/1983 | European Pat. Off. . |
| 144099 | 6/1985 | European Pat. Off. . |
| 221581 | 5/1987 | European Pat. Off. . |
| 185422 | 6/1988 | European Pat. Off. . |
| 0 452 021 | 10/1991 | European Pat. Off. . |
| 1107641 | 1/1956 | France . |
| 72.20922 | 1/1973 | France . |
| 3245626 A1 | 7/1983 | Germany . |
| 41 42 043 | 9/1992 | Germany . |
| 1349515 | 4/1974 | United Kingdom . |
| 2029182 | 3/1980 | United Kingdom . |
| 2285821 | 7/1985 | United Kingdom . |

*Primary Examiner*—Robert E. Pezzuto
*Attorney, Agent, or Firm*—Quarles & Brady, LLP

[57] ABSTRACT

A steerable plow configured for underwater towing along a sea bed. The plow includes a plow body and a soil cutting member attached to the body. The soil cutting member is configured for forming a trench in the sea bed in a forward direction of travel of the plow. A tow member is attached to the body for attaching the plow to a tow cable. The tow member defines an effective tow point which is forward of the cutting member. A steering device is provided for creating a steering moment capable of varying the direction of travel. The steering device is positioned rearwardly relative to said tow member.

23 Claims, 10 Drawing Sheets

STEERABLE UNDERWATER PLOW

CROSS REFERENCE TO RELATED APPLICATIONS (Not Applicable)

STATEMENT REGARDING FEDERALLY SPONSORED RESEARCH OR DEVELOPMENT (Not Applicable)

BACKGROUND OF THE INVENTION

1. Technical Field

This invention relates to plows, and more particularly to steerable underwater plows for trenching and cable laying operations.

2. Description of the Related Art

There are commonly known a wide variety of conventional plows which are capable of operating under water for trenching and pipe laying operations on a sea bed. As used herein, the term sea bed shall include the bottom of any body of water including for example, a lake, river or ocean. Typically, such plows include a share or some other type of soil cutting device for forming a trench and are dragged behind a tow vehicle, such as a ship or submarine tractor, by means of a suitable cable. For a variety of reasons, including the avoidance of undersea obstacles, the path required to be plowed is often circuitous, including numerous changes in direction.

There are two basic methods by which the plow direction can be varied. The simplest approach, particularly in the case of plows which are dragged behind a tow vehicle, is to vary the direction of the tow vehicle so that the towing direction exerted on the plow by its cable causes the plow to follow a new path. However, this crude "tow and follow" method of controlling the plow direction has several disadvantages including a certain amount of difficulty in maintaining precise control over the path of the plow. This can present a particular problem where it is necessary to position a pipeline or cable with some accuracy along a designated course. As an improvement to the basic tow and follow system described above, systems have been devised which are comprised essentially of a plow towed by a long cable, split at the lowered end into a bridle whose tow ends are then attached to the plow. By differentially pulling on the two ends of the bridle, a turning moment is produced which slightly angles the plow share from its previous track, and causes a change in the plowing direction. By using a mechanism which always causes the centerline of the tow cable to pass through the plow's "center of resistance" (usually at the location of the soil cutting member), the differential force required to act on the bridle can be minimized. Various systems for achieving this result are disclosed in U.S. Pat. No. 4,759,138 to Grinsted. While such bridle control type systems are an improvement over more basic systems, they suffer from several problems. Most significantly, plows which establish an effective towing point located at the plow's center of resistance suffer a significant degree of straight line tracking instability, since the towing point tends to be located rearwardly relative to the front of the plow. This tracking instability is an undesirable side-effect of these types of steering system which must be designed to translate the relatively small steering forces imparted by the tow cable, to the plow. Such straight line tracking instability is an undesirable characteristic as it tends to cause the plow to veer off course under conditions where a straight trenching path is desired. Further, such plows tend to be rather complicated and are limited in the degree of precision which can be achieved due to the fact that the turning moment caused by the bridle control will be effected by the uncertain position of the long tow cable.

Others have attempted a more direct approach to steer an underwater plow. For example U.S. Pat. No. 4,329,793 to Reece discloses a plow having angularly adjustable skids which have soil engaging blades. However, that system also has a serious disadvantage to the extent that the turning moment generated by the relatively small soil engaging blades may be insufficient to adequately control the plow direction, particularly where the soil conditions are soft and the trench to be cut is relatively deep. Moreover, the design disclosed in Reece also suffers from the straight line tracking instability problem described above, since the effective tow point is located toward the rear of the plow, above the center of resistance.

Thus, it would be desirable to provide a steerable underwater plow having exceptional straight line tracking capability. Further, it would be desirable to provide a plow having excellent maneuverability to accommodate trenching operations where frequent and substantial changes in plowing direction are required.

SUMMARY OF THE INVENTION

In its broadest form, the invention comprises a plow body; a soil cutting member attached to the body and configured for forming a trench in a sea bed in a forward direction; a tow member attached to the body and defining an effective tow point which is forward of the cutting member; and a steering system configured for providing a steering moment to vary the direction of travel. The steering system is positioned rearwardly relative to the tow member, thereby permitting a substantial advantage in tracking stability as compared to conventional steerable plows which provide an effective tow point located substantially over a cutting member.

In one embodiment, of the invention, at least a portion of the soil cutting member defines a steering vane which is pivotable about a pivot axis defined transverse to the sea bed. The steering vane engages the sea bed at an angle relative to the direction of travel for exerting a steering force on the body. According to one aspect of the invention, the steering vane defines a leading edge of the soil cutting member. In a is second embodiment, the steering vane defines a trailing edge of the soil cutting member. In still another embodiment the soil cutting member is pivotable relative to the body and the steering vane is comprised of an entire portion of the soil cutting member.

The steerable plow includes a steering vane drive unit configured for exerting a force on the steering vane to vary the pivot angle of the steering vane relative to the body and direction of travel. A steering control unit is provided for receiving a steering command from a remote location and controlling the drive. One or more skids is mounted to the body for engaging a surface of the sea bed. The one or more skids are advantageously spaced apart from the soil cutting member so as to provide support for the body. The steerable plow further includes at least one towing member for attaching the plow to a tow cable.

In a further alternative embodiment, the plow may be comprised of a body with a soil cutting member attached thereto for forming a trench in the sea bed in a direction of travel of the plow. A steering vane is pivotally mounted to the body about a pivot axis defined transverse to the sea bed such that the steering vane engages the sea bed at an angle relative to the direction of travel for exerting a steering force on the body. The plow can be arranged so that the pivot axis intersects the body adjacent to a leading edge of the soil cutting member or adjacent to a trailing edge of the soil cutting member. As a further alternative, the pivot axis for the steering vane can be provided at a trailing end of the body. In either case, the steerable plow may also include a second steering vane pivotally mounted to the body about a pivot axis defined transverse to said sea bed. The steering vanes can be positioned laterally adjacent to one another, but may also be located longitudinally spaced along the plow in the direction of travel. They may be configured to pivot together in the same direction or in opposite directions. A steering vane drive unit is provided for exerting a force on the steering vane to vary a pivot angle of the steering vane. Likewise, the plow can include steering control apparatus for receiving a steering command from a remote location and controlling the drive unit.

In still another alternative embodiment, a steerable plow configured for underwater towing along a sea bed is provided which includes a body and a soil cutting member attached to the body. One or more steering members are attached to the body and spaced apart therefrom in a direction transverse to the direction of travel. The one or more steering members are configured for selective engagement with the sea bed for exerting a steering force on the body. As with the previously described embodiment, the steering member drive unit is provided for exerting a force on the steering member to cause the selective engagement with the sea bed. A steering control unit is operatively connected to the steering member drive for receiving a steering command from a remote location and controlling the drive. The steering members are advantageously laterally aligned with the soil cutting member to provide effective steering with a minimal amount of mechanical stress on the plow. As with the other embodiments, the steerable plow may include one or more skids spaced apart from the soil cutting member and attached to the body for engaging a surface of the sea bed. Likewise, one or more towing members are preferably provided for attaching the plow to a tow cable.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE INVENTION

Figure 1:
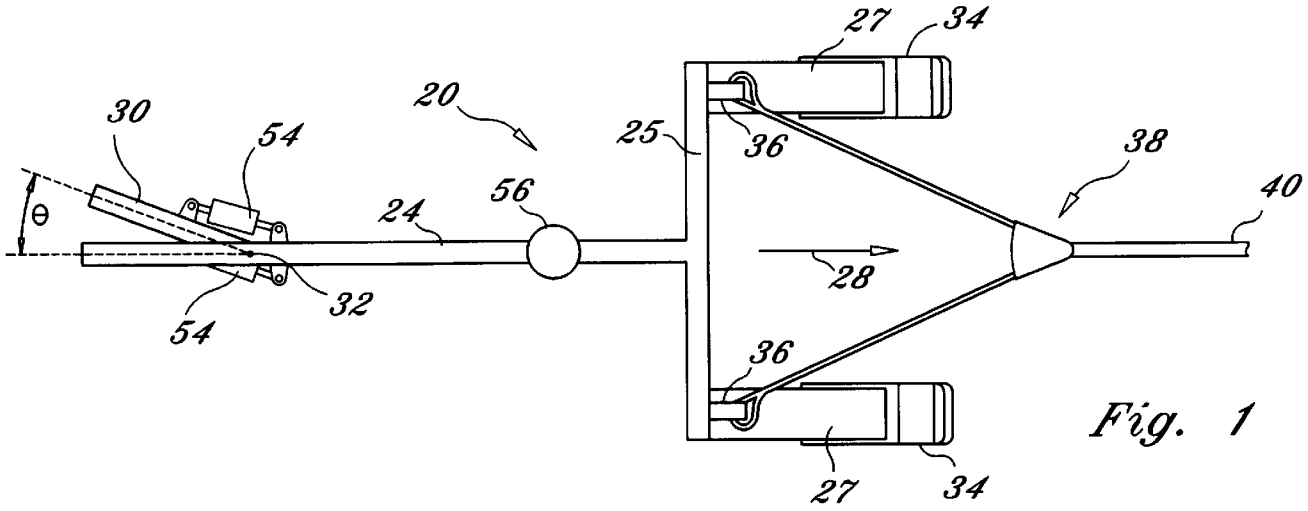
FIG. 1 is a top view of a first embodiment of a steerable plow having a trailing end steering vane.

FIGS. 1–3, 4–6, 7–9, 10–11 and 12–14 show five embodiments of a steerable plow 20, 20*a*, 20*b*, 20*c* and 20*d* which are each configured for underwater towing along a sea bed 22. As shown in FIGS. 1–14, each plow includes a body 24 and a soil cutting member 26 attached to the body. One or more skids 34 is mounted to the body 24 for engaging the surface of the sea bed. The skids 34 are preferably mounted on opposing ends of cross member 25 on skid supports 27. The skids 34 are advantageously spaced apart longitudinally from the soil cutting member 26 so as to provide support for opposing ends of the body 24. The steerable plow 20, 20*a*, 20*b*, 20*c*, 20*d* preferably includes towing members 36 which define hitch points for a bridle 38. Bridle 38 is attached to a tow cable 40 which extends to a ship or underwater tractor (not shown). Each plow 20, 20*a*, 20*b*, 20*c* and 20*d* is configured for forming a trench in the sea bed 22 in a direction of travel 28.

Significantly, in each of the embodiments shown in FIGS. 1–14, the towing members 36 define an effective tow point which is forward relative to the plow's center of resistance defined by the soil cutting member 26. This arrangement results in a substantial improvement in straight line tracking capability as compared to conventional steerable plows. In conventional steerable plows, the effective tow point is designed to be at or near the center of resistance in order to most effectively utilize the relatively small steering forces transmitted to the plow by the tow cable. In such plows, straight line stability is necessarily sacrificed. Moreover, complex mechanical systems are often required to translate the actual tow point at the front of the plow to an effective tow point, located over the cutting member, in order to achieve effective results. By comparison, the steering arrangements disclosed herein provide very powerful steering forces independent of the tow cable, and therefore avoid the need to position the effective tow point at or near the plow's center of resistance.

Figure 2:
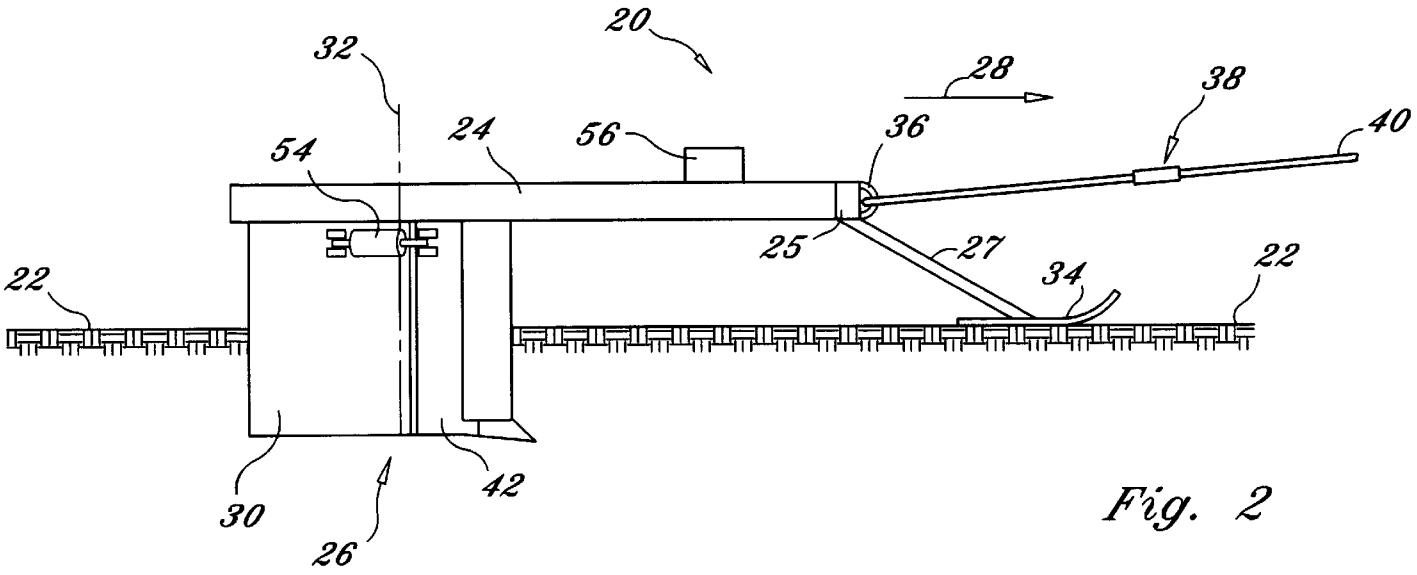
FIG. 2 is a side view of the steerable plow in FIG. 1.
Figure 3:
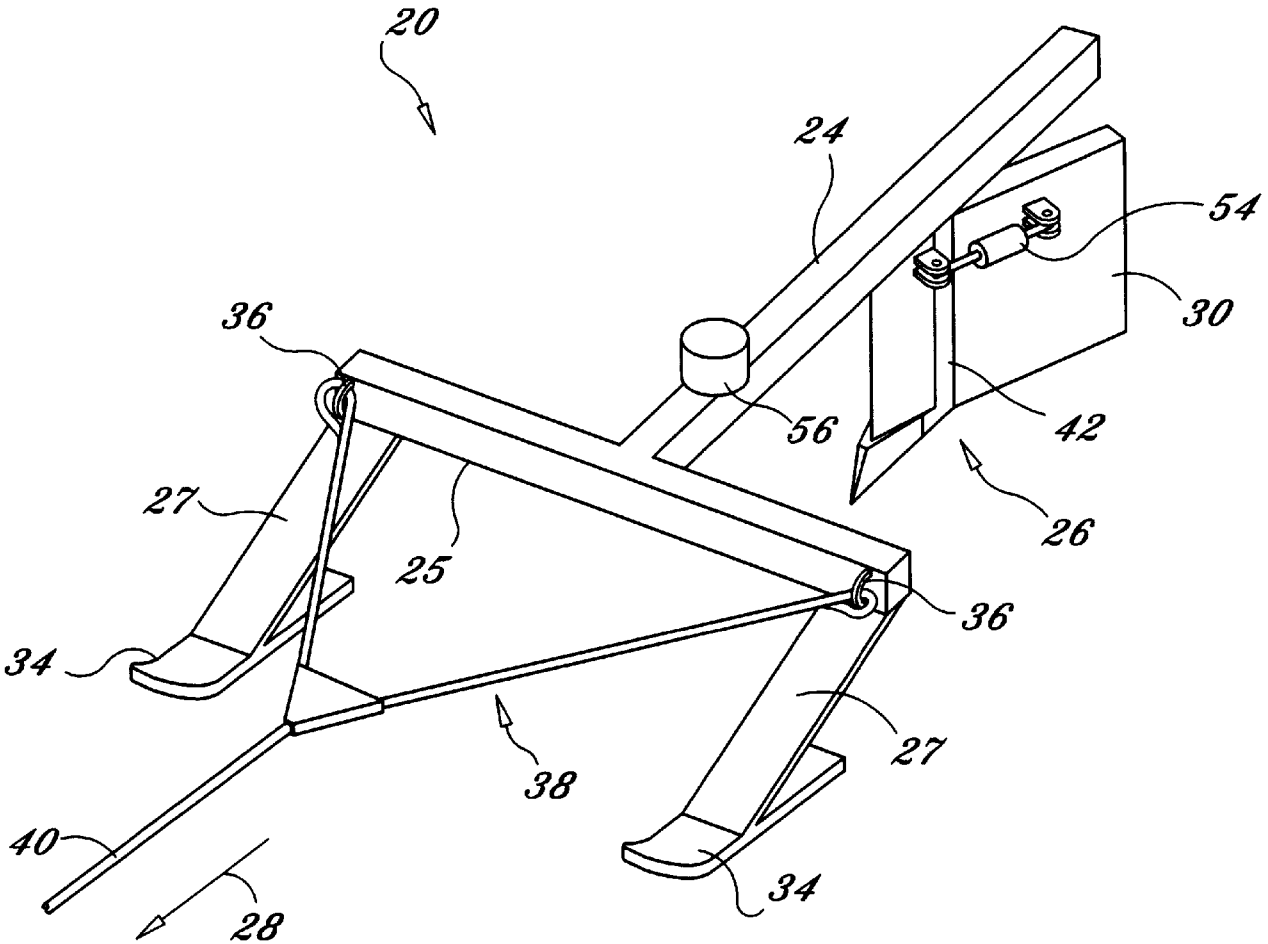
FIG. 3 is a perspective view of the steerable plow in FIG. 1.

In the embodiment of plow 20 shown in FIGS. 1–3, a portion of the soil cutting member 26 defines a steering vane 30 which is pivotable about a pivot axis 32 defined transverse to the sea bed. As best shown in FIG. 1, the steering vane 30 engages the sea bed at an angle $\theta$ relative to longitudinal axis of body 24 coinciding with the direction of travel 28. In the embodiment shown in FIGS. 1–3, the steering vane 30 is formed as part of a trailing section of the soil cutting member 26 in that it follows the fixed portion 42 of the soil cutting member 26. In operation, when the angle $\theta$ is not equal to zero ($\theta \neq 0$), the steering vane 30 exerts a steering force on the body 24 resulting primarily from the engagement of the steering vane with the sea bed and, to a substantially lesser extent, from the force of water moving over the vane. The steering force or moment thus generated causes a change in the direction of travel.

Figure 4:
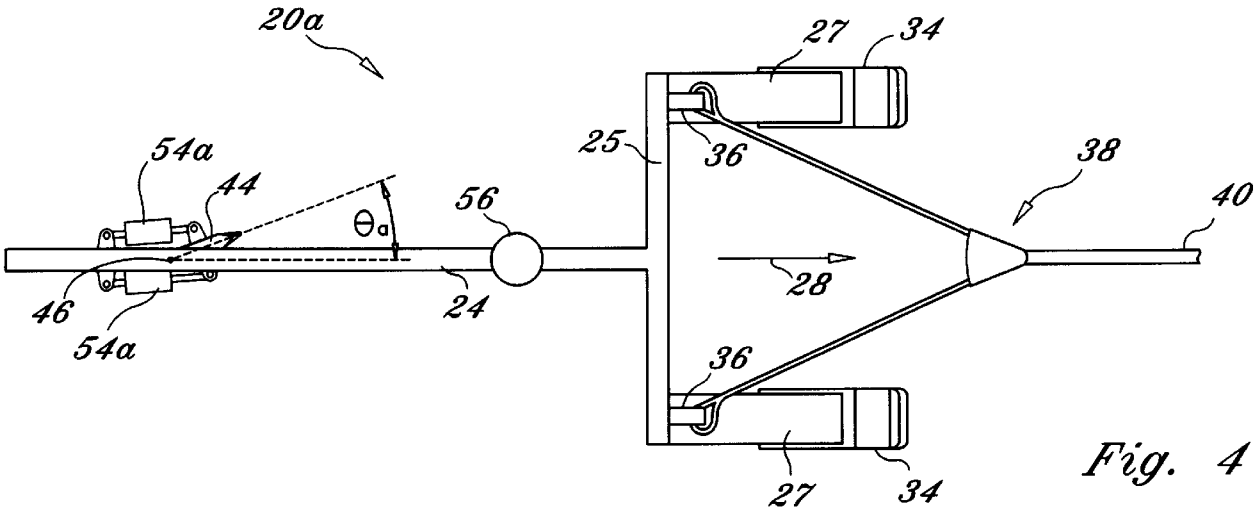
FIG. 4 is a top view of a second embodiment of a steerable plow having a leading end steering vane.
Figure 5:
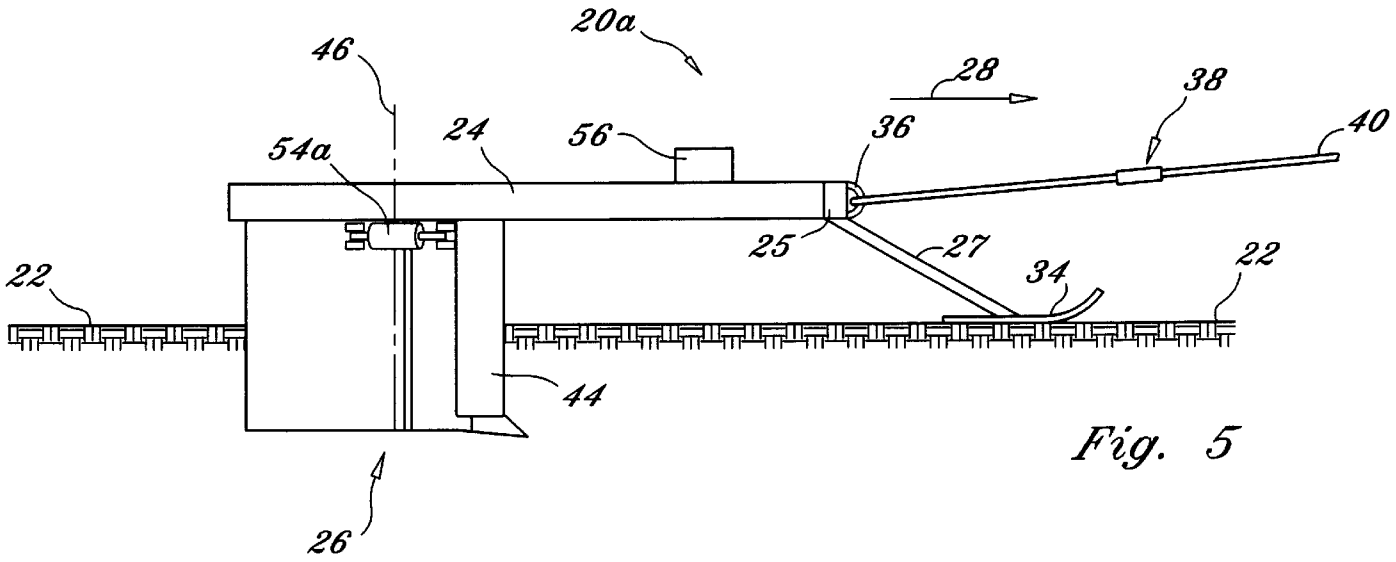
FIG. 5 is a side view of the steerable plow in FIG. 4.
Figure 6:
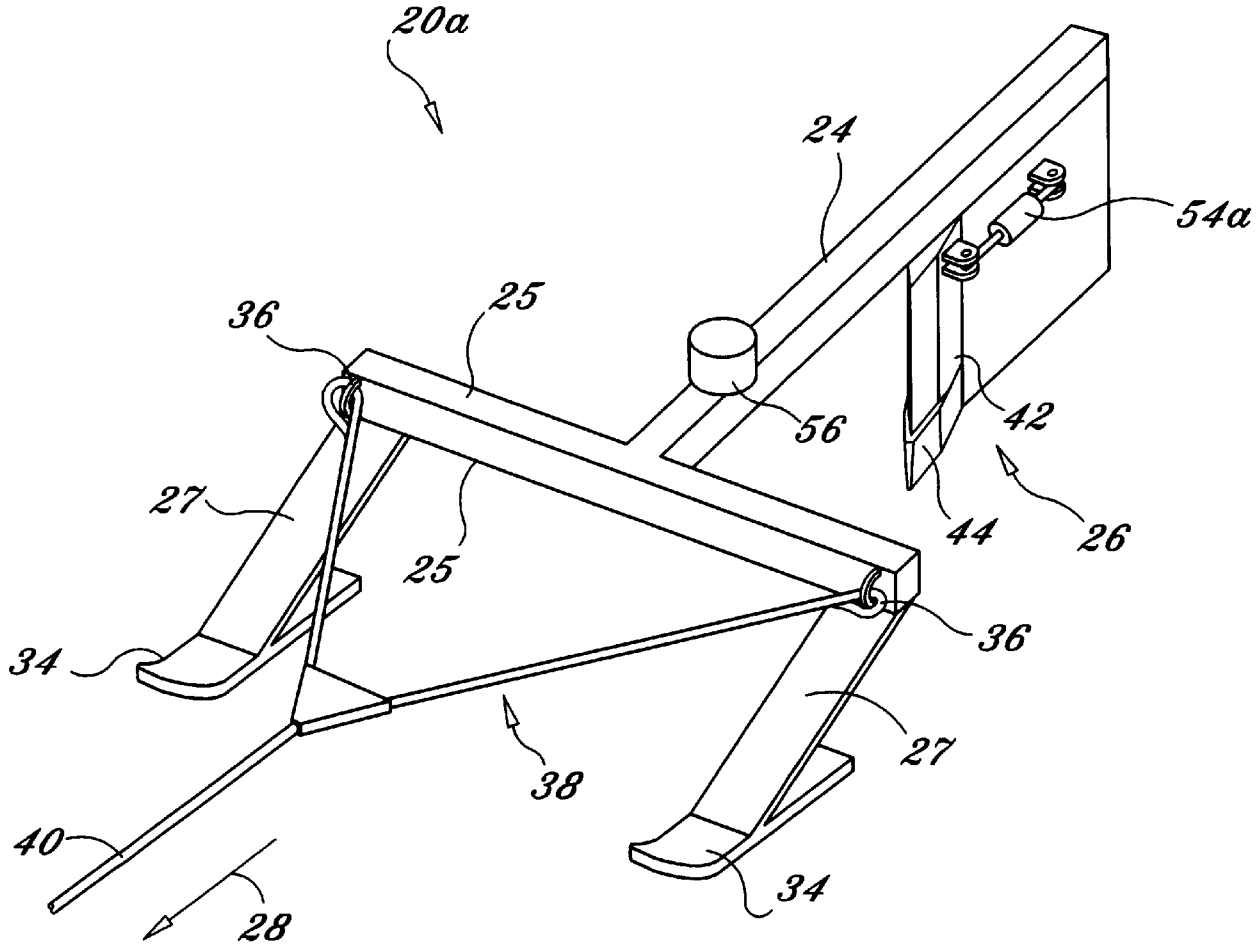
FIG. 6 is a perspective view of the steerable plow in FIG. 4.

In the second embodiment of plow 20*a* shown in FIGS. 4–6, a portion of the soil cutting member 26 again defines a steering vane. In this embodiment however, the steering vane 44, which is pivotable about a pivot axis 46, is positioned at the forward or leading end of the of the soil cutting member. As best shown in FIG. 4, the steering vane 44 engages the sea bed at an angle $\theta_a$ relative to the longitudinal axis of body 24. When the angle $\theta_a$ is not equal to zero ($\theta \neq 0$), the steering vane 44 exerts a steering force on the body 24 resulting from the engagement of the steering vane with the sea bed. Once again, the steering force or moment generated by the engagement of the steering vane with the soil and water causes a change in the direction of travel.

Figure 7:
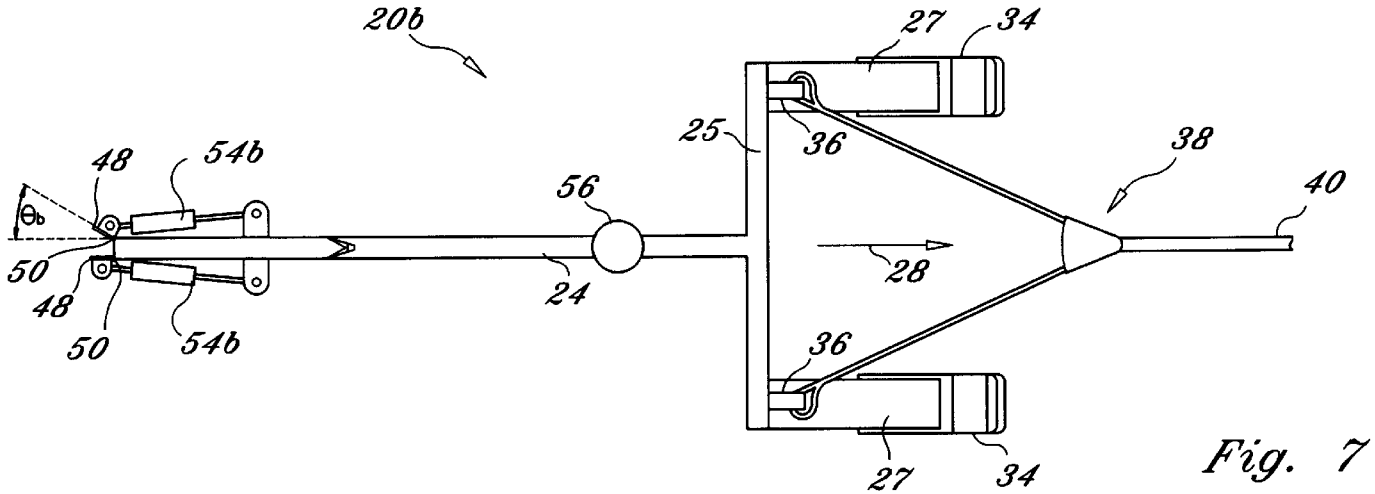
FIG. 7 is a top view of a third embodiment of a steerable plow having a pair of steering vanes located at a trailing end of the plow body.
Figure 8:
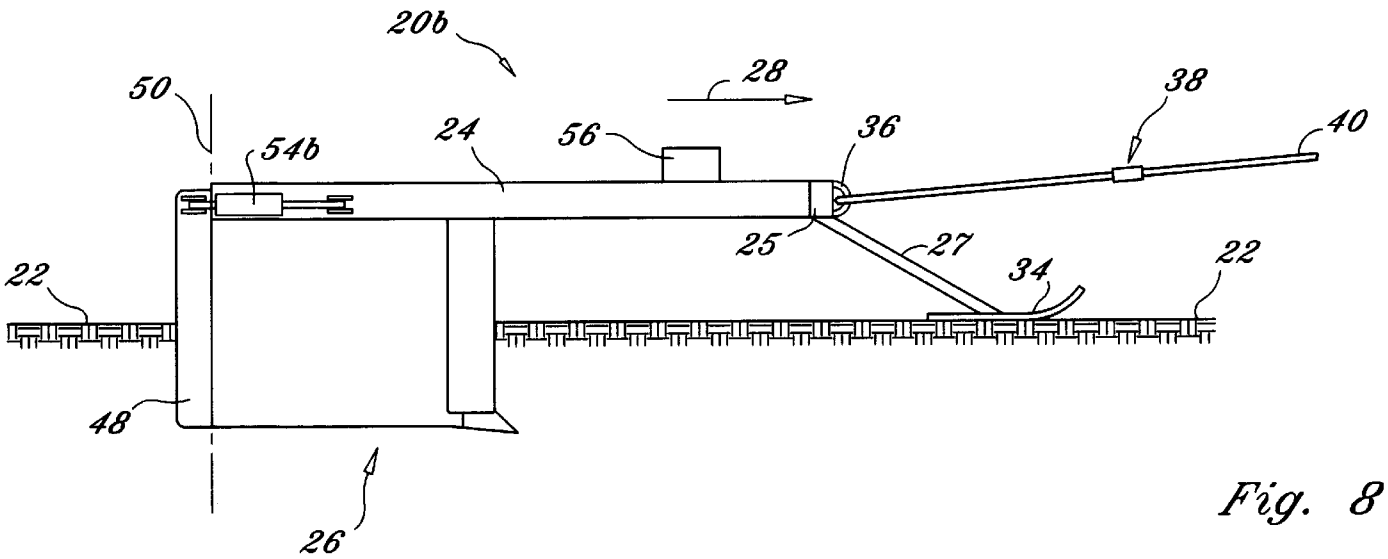
FIG. 8 is a side view of the steerable plow in FIG. 7.
Figure 9:
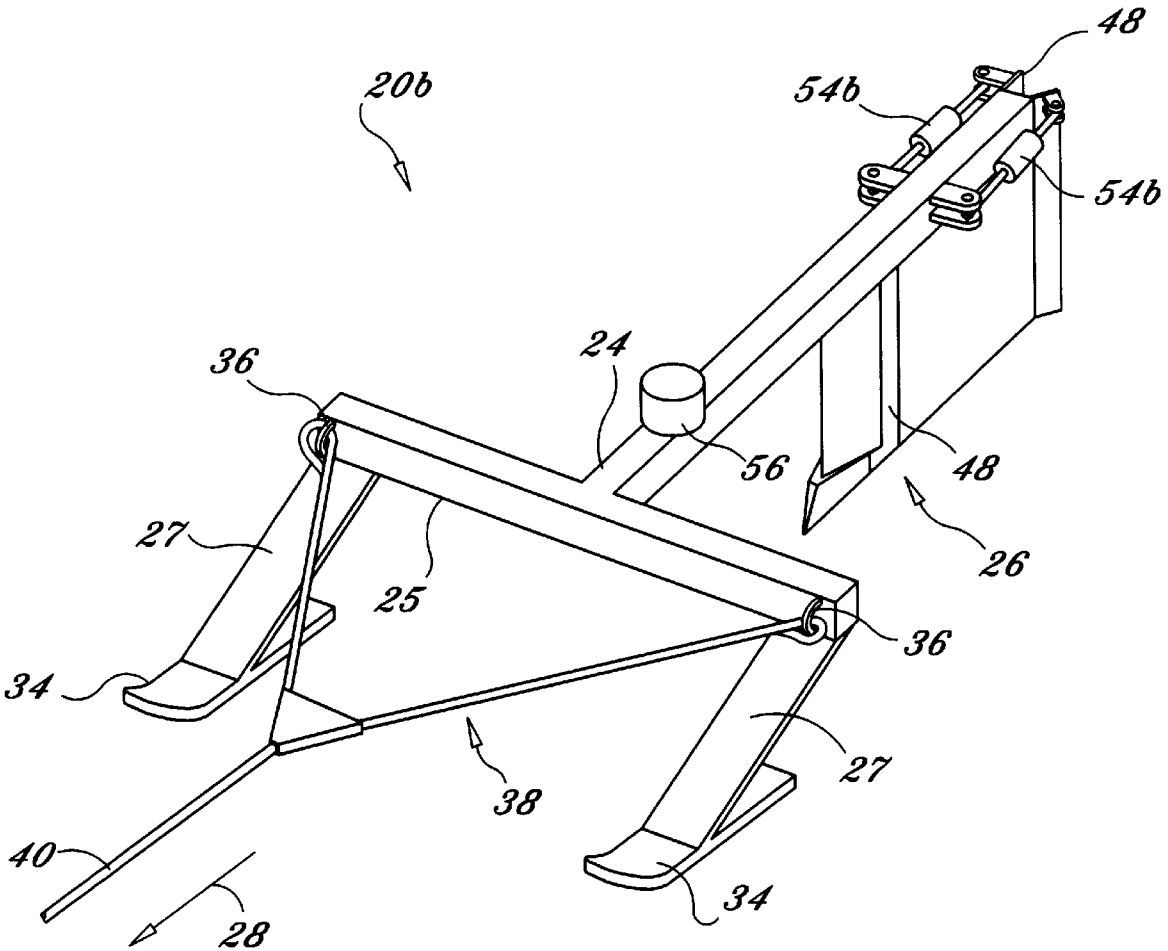
FIG. 9 is a perspective view of the steerable plow in FIG. 7.

In the third embodiment 20*b* of the plow, which is shown in FIGS. 7–9, a pair of steering vanes 48 are provided on body 24. In a preferred embodiment illustrated in FIGS. 7–9, the pair of steering vanes 48 are positioned at a trailing end of the plow body 24, laterally adjacent to one another. However, it should be noted that the invention is not limited in this regard. In an alternative embodiment, the steering vanes 48 may be positioned adjacent to one another at the leading end of soil cutting device 26. The steering vanes are preferably positioned adjacent to one another as shown in FIGS. 7–9. However, the invention is not limited in this regard and the steering vanes 48 may also be positioned on opposing ends of a cross-member mounted on a portion of the body 24. Alternatively, one vane 48 may be positioned at a leading end of the soil cutting member 20 while a second vane is positioned at a trailing end. In any case, the steering vanes 48 are preferably configured so that they can pivot together in the same direction or in opposite pivot directions.

As best shown in FIG. 7, one or both steering vanes 48 engage the sea bed at an angle $\theta_b$ relative to the longitudinal axis of body 24. When the angle for either steering vane is not equal to zero ($\theta_b \neq 0$), the steering vane 48 exerts a steering force on the body 24 resulting from the engagement of the steering vane with the sea bed and the passing water. Once again, the steering force or moment generated by the engagement of the steering vane or vanes with the soil causes a change in the direction of travel.

It should be noted that the embodiment of the invention shown in FIGS. 7–9 is particularly advantageous for use with cable laying trenching operations involving the use of repeater boxes or other oversized discontinuities in the cable which is to be inserted into a trench. In conventional systems, when such an oversized discontinuity is encountered in the cable, one or more auxiliary plow shares must be engaged. Significantly, however, the auxiliary plow shares tend to be physically quite large and somewhat prone to snagging underwater obstructions and interfering with the trenching operation when not in use. The mechanical structure and control systems for such auxiliary plows also tend to be rather complex and therefore prone to failure. By comparison, with the dual steering vane steering system illustrated in FIGS. 7–9, when an oversized discontinuity in a cable or pipe is encountered, the steering vanes 48 may each be pivoted away from the longitudinal centerline of the body 24 to an extended position on either side of the soil cutting member 26. In this way the width of the trench formed by the plow 20*b* is substantially increased in size to accommodate the oversized discontinuity. Thereafter, the steering vanes 48 can be pivoted inwardly and resume their normal steering function. This system is more compact than auxiliary plow systems of the prior art and avoids the complexities associated with such conventional systems.

Figure 10:
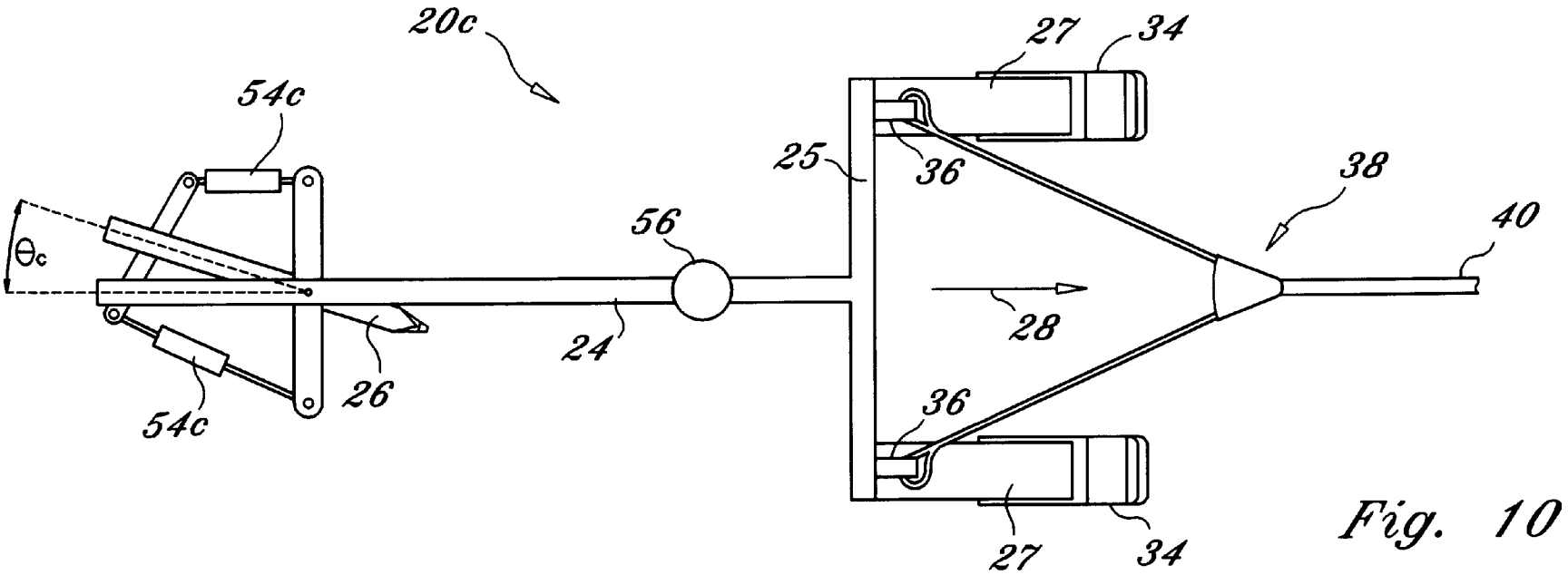
FIG. 10 is a top view of a fourth embodiment of a steerable plow having a pivotable soil cutting member.
Figure 11:
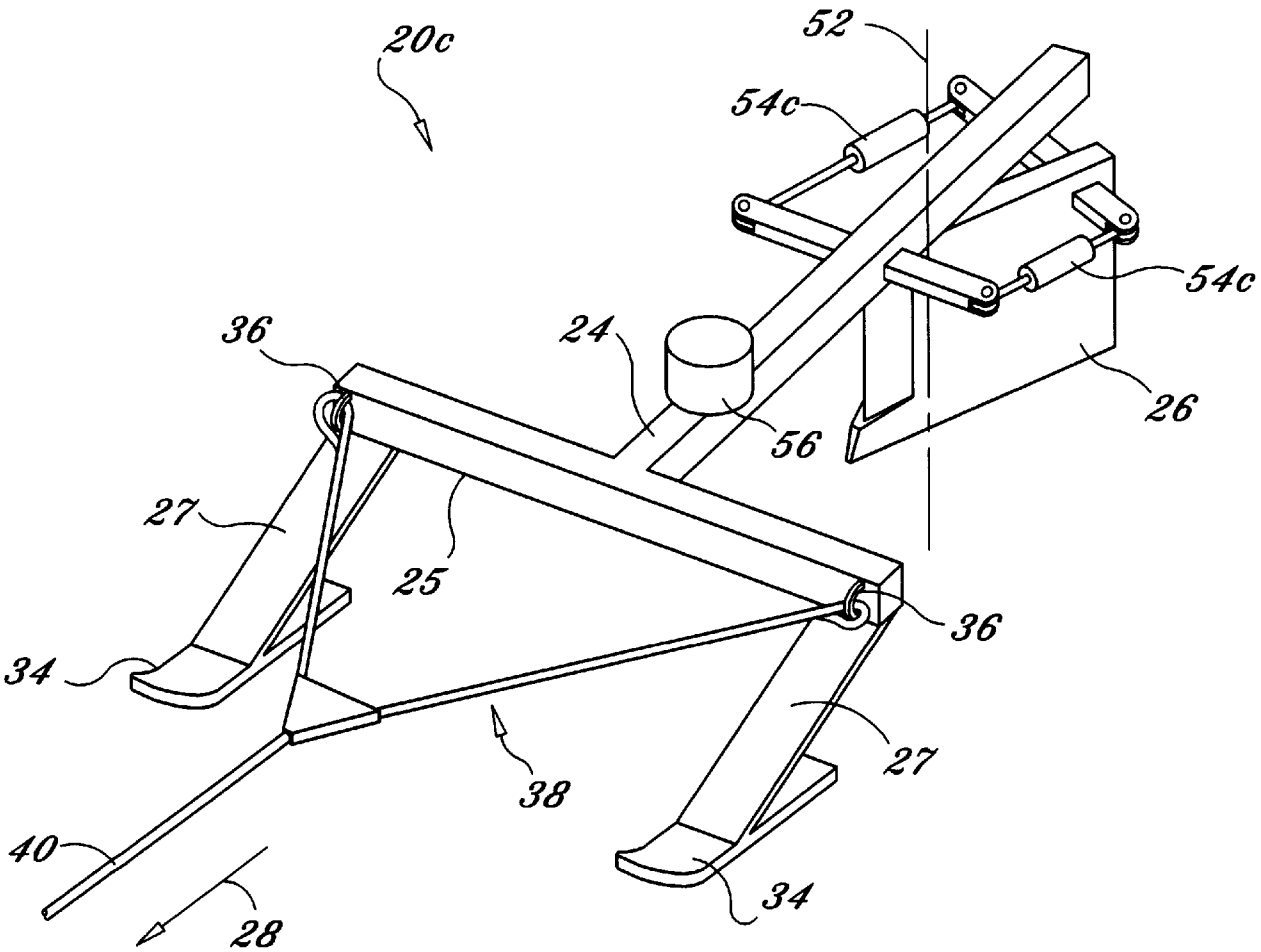
FIG. 11 is a perspective view of the steerable plow in FIG. 10.

FIGS. 10–11 illustrate a fourth embodiment 20*c* of a steerable plow according to the invention. As shown therein, the entire soil cutting member 26 is pivoted about a pivot axis 52 and thereby functions as a steering vane. Similarly to the previously described embodiments, when the angle $\theta_c$ is not equal to zero ($\theta_c \neq 0$), the soil cutting member exerts a steering force on the body 24 resulting from the engagement of the cutting member with the sea bed and, to a much lesser extent, from the water moving over the exposed cutting member surfaces. The steering force or moment thus generated causes a change in the direction of travel.

With regard to each of the steerable plows 20, 20*a*, 20*b* and 20*c*, a steering drive unit 54, 54*a*, 54*b*, 54*c* is preferably provided. The steering drive unit is configured for exerting a force on the steering vane 30, 44, 48 or soil cutting member 26 (in FIGS. 10–11) as the case may be, to vary the pivot angle 6 relative to the body and direction of travel. The steering drive unit 54, 54*a*, 54*b*, 54*c* is preferably a hydraulically, pneumatically, or electrically operated system which may be controllably activated to achieve a desired pivot angle. Hydraulic or pneumatic pistons are shown for this purpose in FIGS. 1–11. However, it will be appreciated by those skilled in the art that the invention is not limited in this regard and any other suitable drive means, including an electromechanical system, may also be used to pivot the steering vanes 30, 44, 48 or soil cutting member 26 in the case of the embodiment shown in FIGS. 10 and 11.

Further, in the case of each of the plows 20, 20*a*, 20*b*, 20*c*, a steering control unit 56 is provided. The steering control unit is preferably configured for receiving a steering command from a remote location and controlling the steering drive unit 54, 54*a*, 54*b*, 54*c* respectively on each plow. Alternatively, the steering control unit may include an appropriate internal guidance system capable of allowing the plow 20, 20*a*, 20*b*, 20*c* to follow a predetermined, preprogrammed path. In either case, the steering control unit preferably includes sensing means for sensing the pivot angle of each of the steering vanes 30, 44, 48 or soil cutting member 26 in the embodiment of FIGS. 10–11. In a preferred embodiment, the steering control unit is comprised of a programmable computer to aid in the proper positioning of the steering vanes or soil cutting member so as to cause a desired response to a particular steering command, or as an aid to achieving a particular trenching path.

Figure 12:
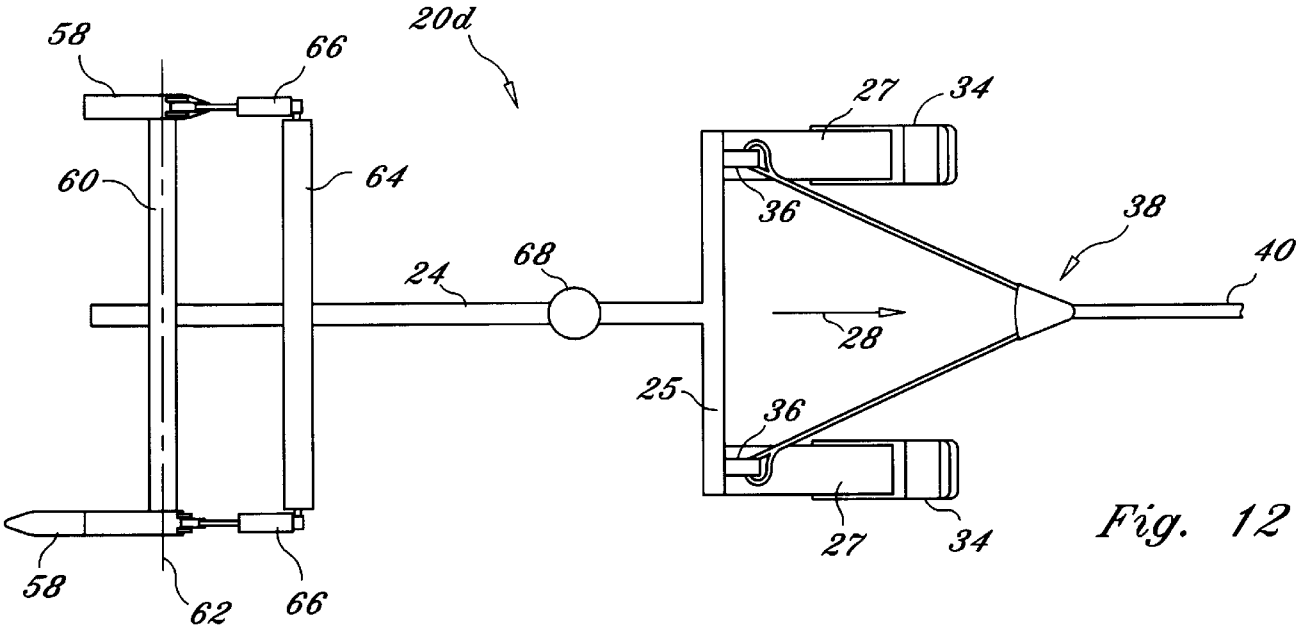
FIG. 12 is a top view of a fourth embodiment of a steerable plow having a pair of soil engaging members.
Figure 13:
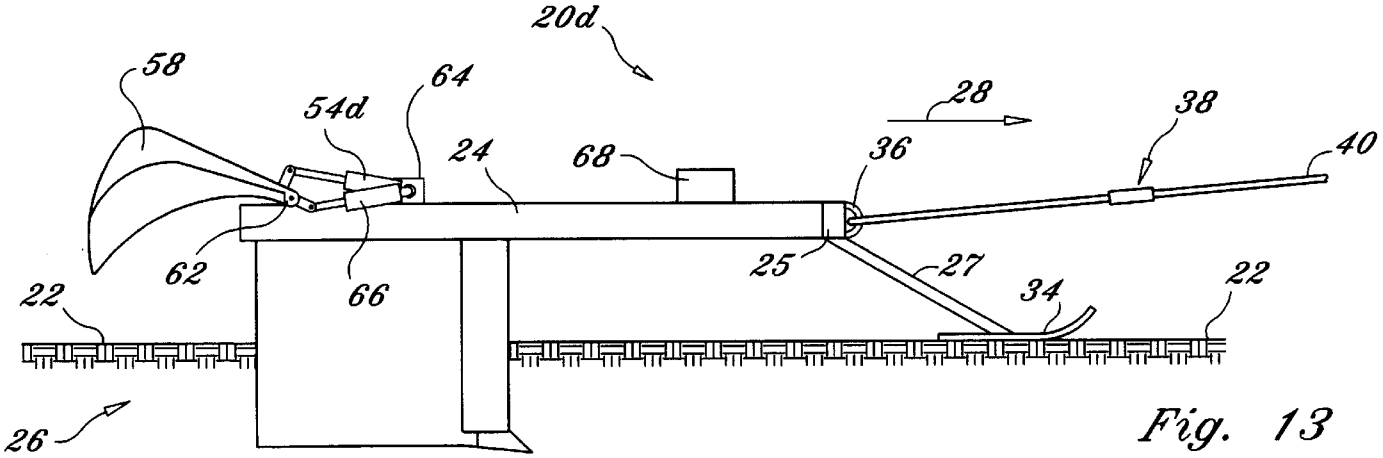
FIG. 13 is a side view of the steerable plow in FIG. 12
Figure 14:
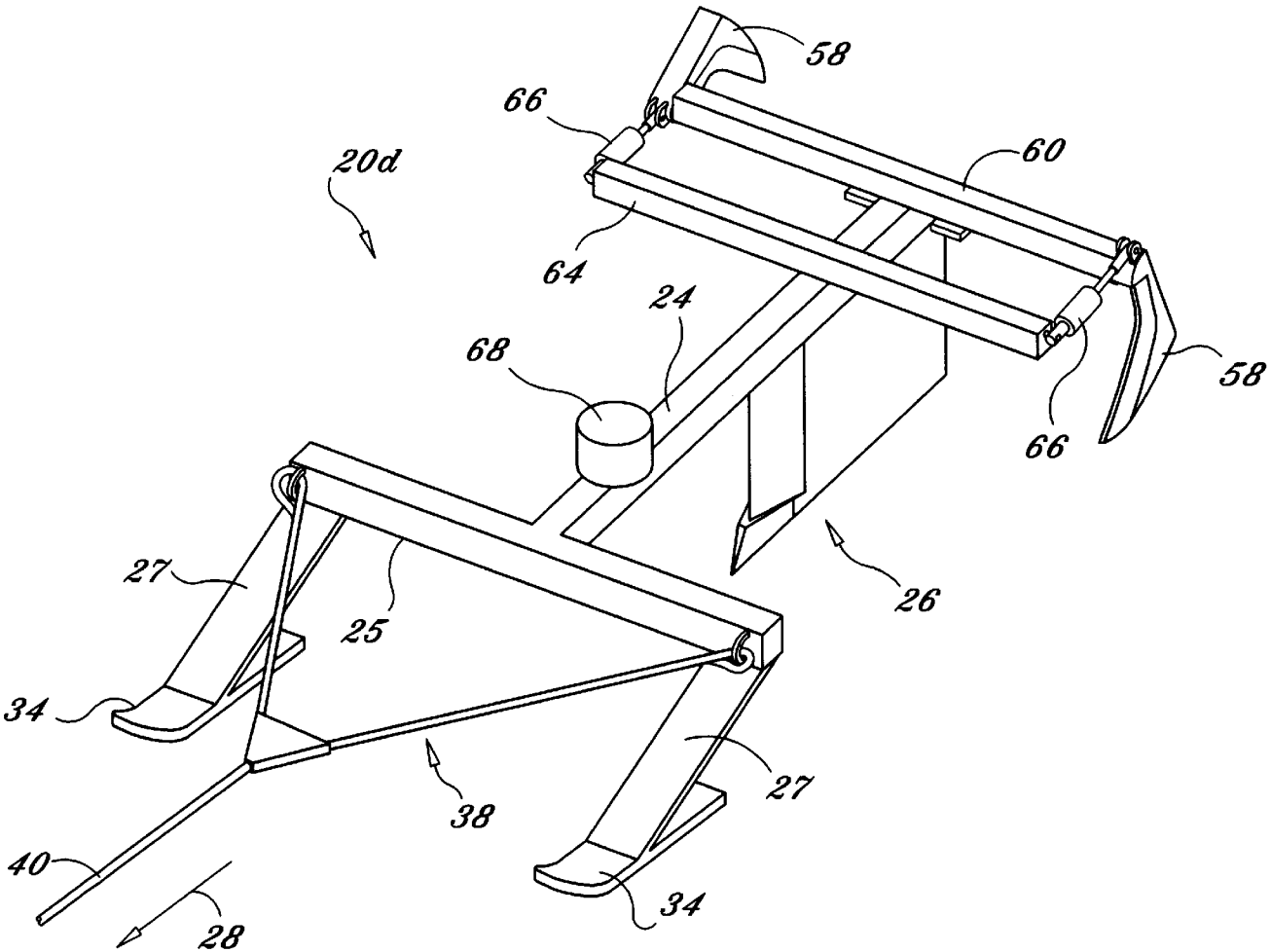
FIG. 14 is a perspective view of the steerable plow in FIG. 12

An alternative fifth embodiment of a steerable plow configured for underwater towing along a sea bed is shown in FIGS. 12–14. As shown therein, the plow 20*d* is similar to the embodiments shown in FIGS. 1–11 except that in place of a pivotable steering vane or soil cutting member, the unit includes one or more steering members 58 which are attached to the body by means of outrigger 60, spaced apart from the body 24 in a direction transverse to the direction of travel. The steering members 58 are preferably laterally aligned with the soil cutting member to provide most effective steering with a minimal amount of mechanical stress on the outriggers 60. However, the invention is not limited in this regard.

As shown in FIGS. 12–14, the steering members 58 are pivotally mounted to outrigger 60 and are configured for selective engagement with the sea bed 22 by pivoting or otherwise moving the position of the steering members as shown. In particular, steering members 58 are independently pivotable about pivot axis 62 to cause steering members 58 to engage sea bed 22. The engagement results in a turning moment sufficient to alter the direction of travel of the body 24. It should be noted that while the steering members 58 are shown in the form of soil cutting units in FIGS. 12–14, the invention is not limited in this regard. Any other suitable configuration or shape can be used for the steering members 58, provided that when they are moved to a position for engagement with sea bed 22, the resultant drag creates a turning moment relative to body 24.

In FIGS. 12–14, it will be appreciated by those skilled in the art that the depth of engagement of the steering members 58 within the sea bed will directly control the amount of steering force exerted on the body 24. By pivoting the steering member so as to more deeply engage the sea bed, a greater turning force will be created. In this manner, the steering members can be used to precisely control the degree of turning force.

In FIGS. 12–14, drive means 66 are used to cause selective pivoting action of each of the steering members 58. The drive means shown in FIGS. 12–14 are hydraulic or pneumatic pistons mounted to cross-member 64. However, other means for effecting such pivot action may also be used, including electromechanical systems. Similarly to the embodiments of the invention shown in FIGS. 1–11, a steering control unit 68 is provided in the embodiment of FIGS. 12–14. The steering control unit is preferably configured for receiving a steering command from a remote location and controlling the steering drive units 66 associated with each steering member 58. Alternatively, the steering control unit may include an appropriate internal guidance system capable of allowing the plow 20*d* to follow a predetermined, pre-programmed path. In either case, the steering control unit preferably includes sensing means for sensing the pivot angle of each of the steering members 58. In a preferred embodiment, the steering control unit is comprised of a programmable computer to aid in the proper positioning of the of the steering members 58 and the depth of their insertion into the sea bed to achieve a particular trenching path.

As the invention can be embodied in other specific forms without departing from the spirit or essential attributes thereof, reference should be made to the following claims, rather than to the foregoing specification, as indicating the scope of the invention.

We claim:

1. A steerable plow configured for underwater towing along a sea bed comprising:

a body;

a soil cutting member attached to said body, and configured for forming a trench in the sea bed in a direction of travel of said plow;

a carriage mounted to said body for supporting a portion of said body on the sea bed;

at least a portion of said soil cutting member defining a steering vane, said steering vane being pivotable about a pivot axis defined transverse to the sea bed, said body and said carriage rigidly connected for maintaining said pivot axis stationary relative to said carriage; and, steering vane drive means configured for exerting a force on said steering vane to vary a pivot angle of said steering vane;

whereby said steering vane engages the sea bed at an angle relative to said direction of travel for exerting a steering force on said body.

2. The steerable plow according to claim 1 further comprising steering control means for receiving a steering command from a remote location and controlling said drive means.

3. The steerable plow according to claim 1, wherein said steering vane defines a trailing edge of said soil cutting member.

4. The steerable plow according to claim 1 further comprising at least one skid attached to said carriage for engaging a surface of said sea bed.

5. A steerable plow configured for underwater towing along a sea bed, comprising:

a body;

a soil cutting member attached to said body, and configured for forming a trench in the sea bed in a direction of travel of said plow;

a carriage mounted to said body for supporting a portion of said body on the sea bed;

at least a portion of said soil cutting member defining a steering vane, said steering vane being pivotable about a pivot axis defined transverse to the sea bed, said body and said carriage rigidly connected for maintaining said pivot axis stationary relative to said carriage, said steering vane defines a leading edge of said soil cutting member;

whereby said steering vane engages the sea bed at an angle relative to said direction of travel for exerting a steering force on said body.

6. A steerable plow configured for underwater towing along a sea bed, comprising:

a body;

a soil cutting member attached to said body, and configured for forming a trench in the sea bed in a direction of travel of said plow;

a carriage mounted to said body for supporting a portion of said body on the sea bed;

at least a portion of said soil cutting member defining a steering vane, said steering vane being pivotable about a pivot axis defined transverse to the sea bed, said body and said carriage rigidly connected for maintaining said pivot axis stationary relative to said carriage, said soil cutting member is pivotable relative to said body and said steering vane is comprised of an entire portion of said soil cutting member;

whereby said steering vane engages the sea bed at an angle relative to said direction of travel for exerting a steering force on said body.

7. A steerable plow configured for underwater towing along a sea bed comprising:

a body;

a soil cutting member attached to said body, and configured for forming a trench in the sea bed in a direction of travel of said plow;

a carriage mounted to said body for supporting a portion of said body on the sea bed;

a towing member attached to said body and defining an effective tow point which is forward of said cutting member;

a steering vane pivotally mounted to said body about a pivot axis defined transverse to the sea bed, said body and said carriage rigidly connected for maintaining said pivot axis stationary relative to said carriage; and, steering vane drive means configured for exerting a force on said steering vane to vary a pivot angle of said steering vane;

whereby said steering vane engages the sea bed at an angle relative to said direction of travel for exerting a steering force on said body.

8. The steerable plow according to claim 7 wherein said pivot axis intersects said body adjacent to a trailing edge of said soil cutting member.

9. The steerable plow according to claim 7 further comprising steering control means for receiving a steering command from a remote location and controlling said drive means.

10. A steerable plow configured for underwater towing along a sea bed, comprising:

a body;

a soil cutting member attached to said body, and configured for forming a trench in the sea bed in a direction of travel of said plow;

a carriage mounted to said body for supporting a portion of said body on the sea bed;

a towing member attached to said body and defining an effective tow point which is forward of said cutting member;

a steering vane pivotally mounted to said body about a pivot axis defined transverse to the sea bed, said body and said carriage rigidly connected for maintaining said pivot axis stationary relative to said carriage, said pivot axis intersects said body adjacent to a leading edge of said soil cutting member;

whereby said steering vane engages the sea bed at an angle relative to said direction of travel for exerting a steering force on said body.

11. A steerable plow configured for underwater towing along a sea bed, comprising:

a body;

a soil cutting member attached to said body, and configured for forming a trench in the sea bed in a direction of travel of said plow;

a carriage mounted to said body for supporting a portion of said body on the sea bed;

a towing member attached to said body and defining an effective tow point which is forward of said cutting member;

a steering vane pivotally mounted to said body about a pivot axis defined transverse to the sea bed, said body and said carriage rigidly connected for maintaining said pivot axis stationary relative to said carriage, said pivot axis intersects said body at a trailing end of said body;

whereby said steering vane engages the sea bed at an angle relative to said direction of travel for exerting a steering force on said body.

12. A steerable plow configured for underwater towing along a sea bed, comprising:

a body;

a soil cutting member attached to said body, and configured for forming a trench in the sea bed in a direction of travel of said plow;

a carriage mounted to said body for supporting a portion of said body on the sea bed;

a towing member attached to said body and defining an effective tow point which is forward of said cutting member;

a steering vane pivotally mounted to said body about a pivot axis defined transverse to the sea bed, said body and said carriage rigidly connected for maintaining said pivot axis stationary relative to said carriage; and, a second steering vane pivotally mounted to said body about a pivot axis defined transverse to the sea bed;

whereby said steering vane engages the sea bed at an angle relative to said direction of travel for exerting a steering force on said body.

13. The steerable plow according to claim 12 wherein said steering vanes are configured to pivot in opposite directions.

14. The steerable plow according to claim 12 wherein said steering vanes are positioned laterally adjacent to one another.

15. The steerable plow according to claim 14 wherein said steering vanes are configured to pivot in the same direction.

16. The steerable plow according to claim 14 wherein said steering vanes are configured to pivot in opposite directions.

17. The steerable plow according to claim 12 wherein said steering vanes are configured to pivot in the same direction.

18. A steerable plow configured for underwater towing along a sea bed comprising:

a body having a longitudinal axis;

a soil cutting member attached to said body and configured for forming a trench in the sea bed;

a carriage mounted to said body for supporting a portion of said body on the sea bed;

a towing member attached to said body and defining an effective tow point which is forward of said cutting member; and, steering means attached to said body at a connection point, said steering means including at least one steering member, said steering member positionable by said steering means to engage the sea bed to create a steering force having a direction non-aligned with said longitudinal axis, said steering member exerting the steering force on said body at said connection point, said body and said carriage rigidly connected for maintaining the connection point between said body and said steering means stationary relative to said carriage.

19. The steerable plow according to claim 18, further comprising steering control means for receiving a steering command from a remote location and controlling said drive means.

20. The steerable plow according to claim 18 wherein said at least one steering member is laterally aligned with said soil cutting member.

21. The steerable plow according to claim 18, further comprising at least one skid attached to said body for engaging a surface of said sea bed, said at least one skid spaced apart from said soil cutting member.

22. The steerable plow according to claim 18 further comprising at least one towing member for attaching said plow to a tow cable.

23. A steerable plow according to claim 18, further comprising steering member drive means configured for exerting a force on said at least one steering member to selectively engage the steering member, and wherein said at least one steering member is spaced apart from said body in a direction transverse to said direction of travel.

* * * * *

UNITED STATES PATENT AND TRADEMARK OFFICE

CERTIFICATE OF CORRECTION

PATENT NO : 6,050,009
DATED : April 18, 2000
INVENTOR(S) : ADAMSON, James E., et al It is certified that error appears in the above-identified patent and that said Letters Patent are hereby corrected as shown below:

Column 6, line 12, replace "6" with --θ--.

Signed and Sealed this

Third Day of April, 2001

*Attest:*

Nicholas P. Godici

NICHOLAS P. GODICI

*Attesting Officer*

*Acting Director of the United States Patent and Trademark Office*